US006561153B2

(12) United States Patent
Uchida

(10) Patent No.: US 6,561,153 B2
(45) Date of Patent: May 13, 2003

(54) CYLINDER HEAD SPARK PLUG MOUNTING ARRANGEMENT

(75) Inventor: Masahiro Uchida, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 10/063,013

(22) Filed: Mar. 12, 2002

(65) Prior Publication Data

US 2002/0134341 A1 Sep. 26, 2002

(30) Foreign Application Priority Data

Mar. 21, 2001 (JP) ..... 2001-080827

(51) Int. Cl.[7] ..... F01L 3/00
(52) U.S. Cl. ..... 123/193.5

(58) Field of Search ..... 123/193.5, 193.3, 123/90.27

(56) References Cited

U.S. PATENT DOCUMENTS

| | | | | | |
|---|---|---|---|---|---|
| 5,535,714 | A | * | 7/1996 | Aoyama et al. | 123/193.5 |
| 5,809,968 | A | * | 9/1998 | Tsuchida | 123/193.5 |
| 6,209,507 | B1 | * | 4/2001 | Sakamoto et al. | 123/193.5 |
| 6,279,529 | B1 | * | 8/2001 | Komatsu et al. | 123/193.5 |

* cited by examiner

*Primary Examiner*—Marguerite McMahon
(74) *Attorney, Agent, or Firm*—Ernest A. Beutler

(57) ABSTRACT

An improved compact engine construction that facilitates positioning in close quarters while still affording ease of assembly and servicing. This is accomplished by mounting the camshafts at different heights and by providing a two-piece spark plug tube in the cylinder head that facilitates removal in sections rather than all at once.

6 Claims, 11 Drawing Sheets

CYLINDER HEAD SPARK PLUG MOUNTING ARRANGEMENT

BACKGROUND OF THE INVENTION

This invention relates to an internal combustion engine and more particularly to an improved spark plug mounting arrangement for the cylinder heads of such engine.

With many types of internal combustion engines and particularly those utilized for automotive application, the ignition system includes an individual coil that is associated with each spark plug of the engine. These individual coils are mounted on the upper end of the electrical terminal that connects the coil output to the spark plug. This presents a problem in servicing as may be best understood my reference to FIG. 1, which shows a typical prior art type of construction, utilized for this purpose.

As seen in this figure, an internal combustion engine, indicated generally by the reference numeral 21 has a cylinder head assembly, indicated generally by the reference numeral 22. This cylinder head assembly 22 is comprised of a cylinder head 23 and a cam cover 24 that is affixed to the cylinder head 23 with a sealing gasket interposed there between (not shown). This defines a cam chamber 25 in which a valve actuating mechanism, shown partially and identified by the reference numeral 26 is positioned.

The cylinder head 23 has a lower surface in which combustion chamber recesses 27 are formed. The combustion chamber recesses 27 of the cylinder head defining the combustion chamber is formed with a tapped opening 28 so as to receive the threaded end of a spark plug 29 with its terminals projecting into the combustion chamber.

It will be seen that the upper end of the spark plug 29 extends into a tubular spark plug tube 31 which has its lower end sealingly engaged in a spark plug tube receiving pocket 32 of cylindrical configuration formed in a lower surface 33 of the cylinder head 23. This tubular spark plug tube 31 extends upwardly and passes through an opening 34 formed in the cam cover 24 with a sealing grommet 35 being interposed there between.

The spark plug is fired by a coil 36 that is activated by an associated ignition system and terminal 37 that are inserted into the tubular spark plug tube 31 with the lower end of the terminal engaged with the terminal end of the spark plug 29 as shown in the cylinder to the right in FIG. 1.

A problem in connection with servicing arises, however, when the placement of the engine 21 is such that one or more of the tubular spark plug tube 31 is disposed in an obstructed area. For example, FIG. 1 shows a conventional brake booster 38, which overlies the end cylinder of the engine and accordingly blocks the removal of the coil 36 and terminal 37 for servicing of the spark plug 29.

In addition to the servicing problem, this type of construction also presents difficulty in engine assembly. That is, it is necessary when building the engine or when servicing the engine to place all of the tubular spark plug tube 31 in the cylinder head 23 and then attach the cam cover 24 while guiding the sealing grommets 35 around the periphery of the upwardly projecting tubular spark plug tube 31. The greater number of cylinders, the more difficult it is to connect and assemble them.

It is, therefore, a principal object to this invention to provide an improved cylinder head structure of this general type, but one in which the spark plugs can be easily accessed for servicing without encountering the problems in connection with the prior art type of construction.

It is a further object to this invention to provide an improved spark plug receiving tube assembly for the cylinder head of an internal combustion engine that facilitates servicing and minimizes operational and assembly costs.

SUMMARY OF THE INVENTION

This invention is adapted to be embodied in a cylinder head assembly for an internal combustion engine that comprises a cylinder head and a cam cover. The cam cover is affixed to the cylinder head so as to define a cam chamber between an upper surface of the cylinder head and the interior of the cam cover. The cylinder head is formed with at least one spark plug receiving, threaded hole leading into a combustion chamber of the cylinder head. The cylinder head forms a spark plug tube attaching hole that is greater in diameter than and surrounds the at least one spark plug receiving, threaded hole. A spark plug tube inserting hole is formed in the cam cover and is aligned with the cylinder head spark plug tube attaching hole. A lower spark plug tube is sealingly affixed at one end thereof to the cylinder head spark plug tube attaching hole. An upper spark plug tube is sealing engaged at one end thereof to the cam cover spark plug tube attaching hole and is sealingly engaged at the other end thereof to the other end of the lower spark plug tube.

DETAILED DESCRIPTION

Figure 2:
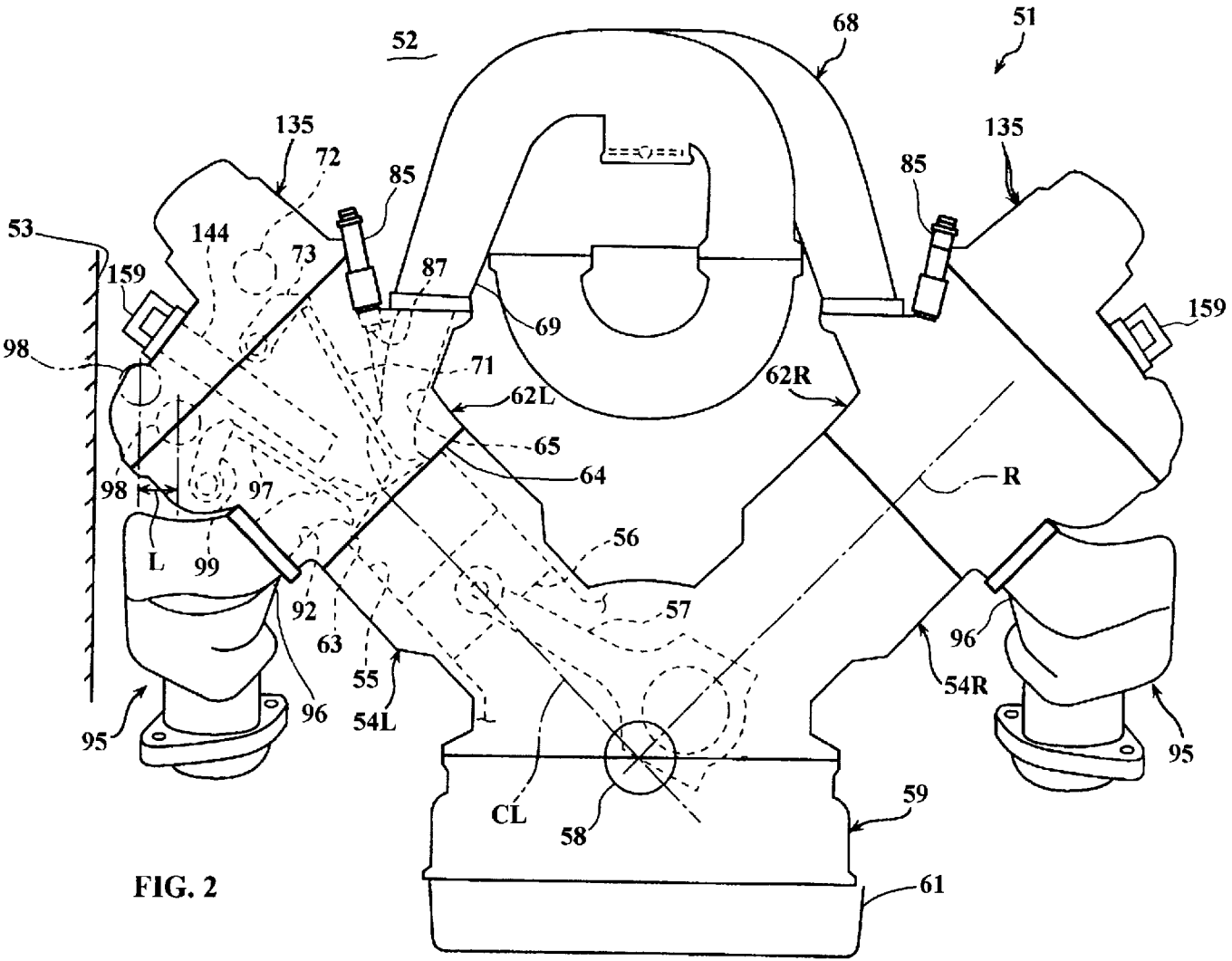
FIG. 2 is an end elevational view of an engine constructed in accordance with an embodiment of the invention and embodied in the engine compartment of an associated vehicle.

Referring now in details and initially primarily to FIG. 2, an engine constructed in accordance with an embodiment of the invention is identified generally by the reference numeral 51. The engine 51 is shown positioned transversely in an engine compartment 52 of an associated motor vehicle. This engine compartment 52 is defined in part by a firewall or toe board 53 of the vehicle body.

The engine 51 is of the V8 type and is comprised of a cylinder block 54 having left and right banks designated by the subscripts 54L and 54R, respectively. These cylinder banks each are formed with four cylinder bores 55, only one of which is shown in broken lines in FIG. 2. Pistons 56 reciprocate in the cylinder bores 55.

Connecting rods 57 connect the pistons 56 to a crankshaft 58 that is rotatably journalled in a crankcase assembly formed by a crankcase member 59 that is affixed to the lower end of the cylinder block 54 and an oil pan 61 that is affixed to and depends therefrom. The axes of the cylinder bores 55 are indicated at CL and CR, respectively, and which intersect at the rotational axis of the crankshaft 58.

Left and right cylinder heads 62L and 62R are affixed to the cylinder banks 54L and 54R, respectively. These cylinder heads 62 are formed with combustion chamber recesses 63 which cooperate with the cylinder bores 55 and pistons 56 to form the combustion chambers of the engine 51. Since the combustion chamber recesses 63 form the major portion of the combustion chamber volume at top dead center position, as times this reference numeral will be used to also designate the combustion chamber.

A lower surface of the cylinder head 62, indicated at 64, surrounds the combustion chamber recess 63 and is held in sealing engagement with the upper surface of the respective cylinder bank 54L and 54R.

Figure 3:
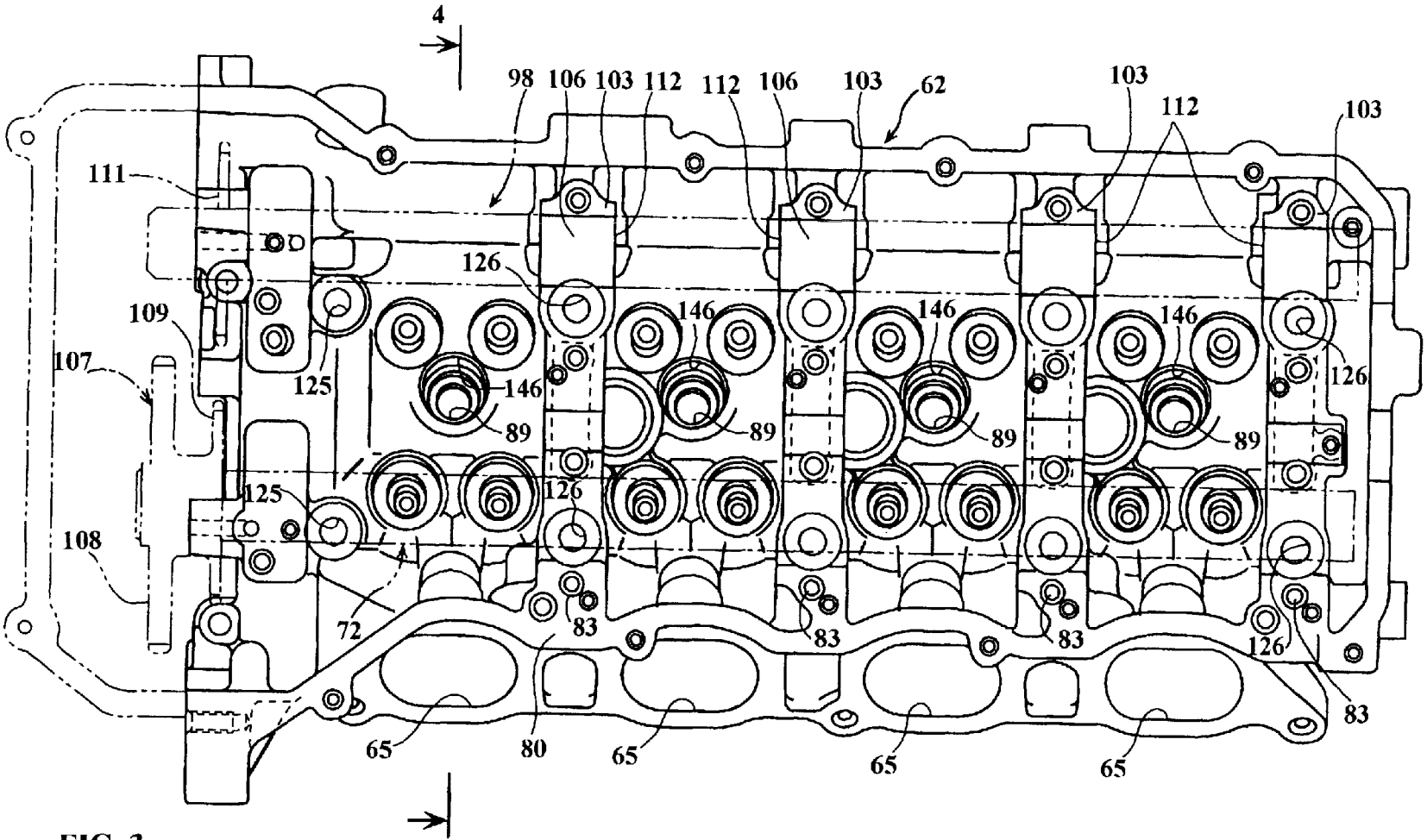
FIG. 3 is a top plane view of the cylinder head of the engine with the cam cover removed and operating components thereof removed.
Figure 4:
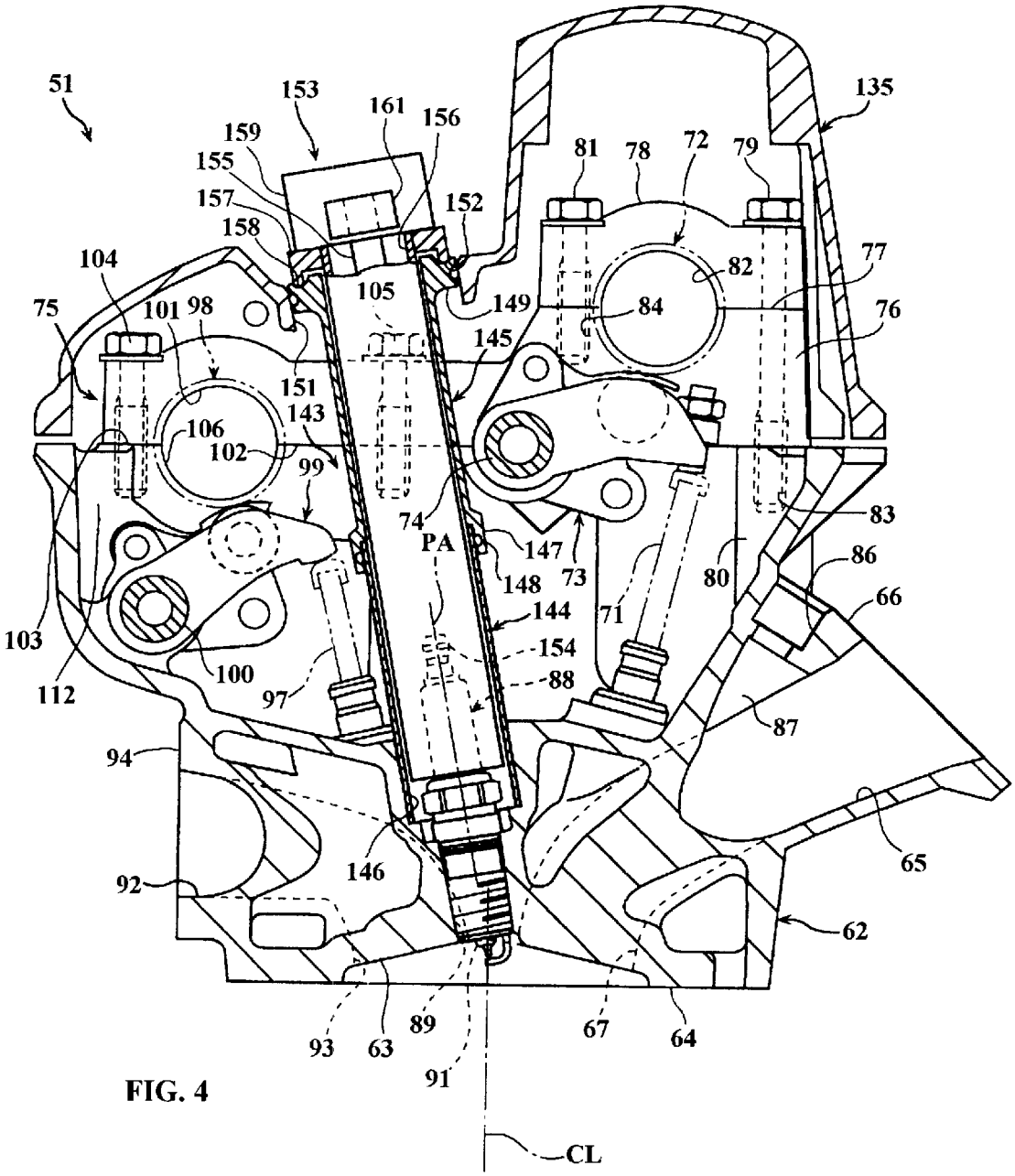
FIG. 4 is a cross sectional view taken along the line 4—4 of FIG. 3 but showing the complete cylinder head assembly.

Referring now additionally and primarily to FIGS. 3 and 4, the construction of each cylinder head 62 will be described in detail. On the side of the respective cylinder head 62 facing the valley between the cylinder banks, there is provided an inlet passage 65 that extends from an outer surface 66 of the cylinder head 62 to a pair of respective valve seats 67. An induction system, indicated generally by the reference numeral 68, is affixed in the valley between the cylinder banks. The induction system 68 includes an air inlet device (not shown) that draws atmospheric air from within the engine compartment 52 and a plenum or surge chamber served by this air inlet. Individual manifold runners 69 extend from the surge chamber of the induction system 68 to the cylinder head intake passages 65 for each bank. Poppet type intake valves 71 cooperate with the valve seats 67 and control the flow of intake air into the combustion chamber 63. These poppet type intake valves 71 are urged to their closed positions by a suitable return spring assembly (not shown). The intake valves 71 are opened by an intake camshaft 72 via a rocker arm assembly 73 that is pivotal in the cylinder head about a rocker arm shaft 74. The intake camshaft 72 is driven at one half crankshaft speed in a manner to be described.

Basically, the mounting for the intake camshaft 72 is provided by a camshaft mounting arrangement, indicated generally by the reference numeral 75 and which will be described in more detail later. This mounting arrangement includes a plurality of axially spaced intermediate bearing portions 76 that are engaged with the upper surfaces of projections 80 formed on the intake side of the cylinder head 62. Each of the intermediate portions has an upper surface 77 formed only on the intake side thereof for a reason to be described. A bearing cap 78 is affixed to this upper surface 77 and the cylinder head 62 by threaded fasteners 79 at the intake side of the cylinder head. The opposite side of the bearing caps 78 is held in place by shorter fasteners 81 that connect the bearing cap 78 only to the intermediate bearing portion 76. Bearing surfaces 82 formed by the intermediate bearing portion 76 and bearing cap 78 cooperate with bearing surfaces on the intake camshaft 72 for its journal support. The fasteners 79 are received in tapped holes 83 formed in the projections 80 of the cylinder head 62. The fasteners 81 are received in threaded openings 84 formed in the intermediate bearing portion 76.

Fuel is mixed with the air charge admitted by the induction system 68 to the combustion chambers 63 by means of fuel injectors 85 that are mounted in receiving openings 86 formed in the cylinder head 62. These openings 86 communicate with the intake passage 65 through a transfer passage 87 so that fuel injected by the injectors 85 will flow smoothly with the intake air into the intake passages 65 and combustion chambers 63. Positioned substantially on the cylinder bore axes CL and CR, are spark plugs 88. The spark plugs 88 are received in threaded spark plug receiving openings 89 formed in the cylinder head 62 and which intersect the combustion chamber recess 63 coincident with the respective cylinder bore axes CL and CR. The spark gap 91 of the spark plugs 88 therefore, lies on the respective cylinder bores axes CL or CR to provide good flame propagation.

The spark plugs 88 are fired in a manner which will be described shortly to initiate combustion and the burning gases expand and drive the pistons 56 downwardly in the cylinder bores 55 so as to drive the crankshaft 58.

Exhaust passages 92 are formed in the cylinder head 62 and extend from exhaust valve seats 93 formed in the combustion chamber recess 63 of the cylinder head 62 to an exit port formed in an outer surface 94 of the cylinder head 62. This outer surface 94 is disposed on the side opposite the intake passages 65.

A suitable exhaust system including an exhaust manifold, indicated generally by the reference numeral 95, is mounted on the cylinder head surface 94 and has individual runner sections 96 that communicate with the exhaust passages 92. A suitable exhaust system (not shown) is attached to the exhaust manifold 95 and discharges the exhaust gases to the atmosphere.

The flow of exhaust gases through the exhaust passages 92 is controlled by means of poppet type exhaust valves 97 that are mounted in the cylinder head 62 on the side opposite the intake valves 71. Like the intake valves 71, the exhaust valves 97 are urged toward their closed positions by coil spring assemblies, which are not shown.

An exhaust camshaft 98 is journalled in the cylinder head 62 in a manner, which will be described. This is exhaust camshaft 98 operates the exhaust valves 97 through a rocker arm assembly 99. The rocker arms of this rocker arm assembly 99 are pivotally supported on a rocker arm shaft 100.

The intermediate bearing portion 76 that support the intake camshaft 72 also support the exhaust camshaft 98. However, in this instance, a bearing surface 101 is formed in a lower part 102 of each intermediate bearing portion 76. This part 102 is engaged with an elevated surface 103 of the cylinder head 62. First and second threaded fasteners 104 and 105 affix the intermediate bearing portion 76 to the cylinder head 62. Thus, because of the fact that the exhaust camshaft 98 is mounted directly on the cylinder head surface 103 and in bearing portions 106 thereof, it can be mounted lower than the intake camshaft 72 which is mounted above the elevated surface 103. The significance of this will be described later.

Like the intake camshaft 72, the exhaust camshaft 98 is also driven at one-half crankshaft speed by a suitable timing drive. Although any known type of timing drive may be used for this purpose, it should be noted from FIG. 4, that the intake camshaft 72 has affixed to its forward end a compound sprocket assembly 107 that is comprised of a first sprocket 108 which is driven from the crankshaft by a suitable driving arrangement at one half crankshaft speed. These places the larger sprocket required for the speed reduction in the area of the valley between the cylinder banks 54L and 54R. A second sprocket 109 is formed in the compound sprocket 107 and drives a third sprocket 111 associated with the exhaust camshaft 98 through a further drive. By placing the larger sprocket required for the speed reduction in the area of the valley between the cylinder banks 54L and 54R the overall width of the engine 51 can be reduced as seen in FIG. 2.

It has been previously noted that the intake and exhaust camshafts 72 and 98 are journalled between the individual cylinders of the engine by the bearing arrangements provided for by the intermediate bearing portions 76 and the bearing caps 78 cooperating with, respectively, the cylinder head elevated surface 103 and the intermediate bearing portion 76 and particularly the bearing surfaces 101 thereof. The cylinder head elevated surface 103 are formed on raised areas 112 of the cylinder head 62 which are generally aligned with the raised portions 80 on the intake side. A similar arrangement is provided at the back ends of the camshafts 72 and 98.

Figure 6:
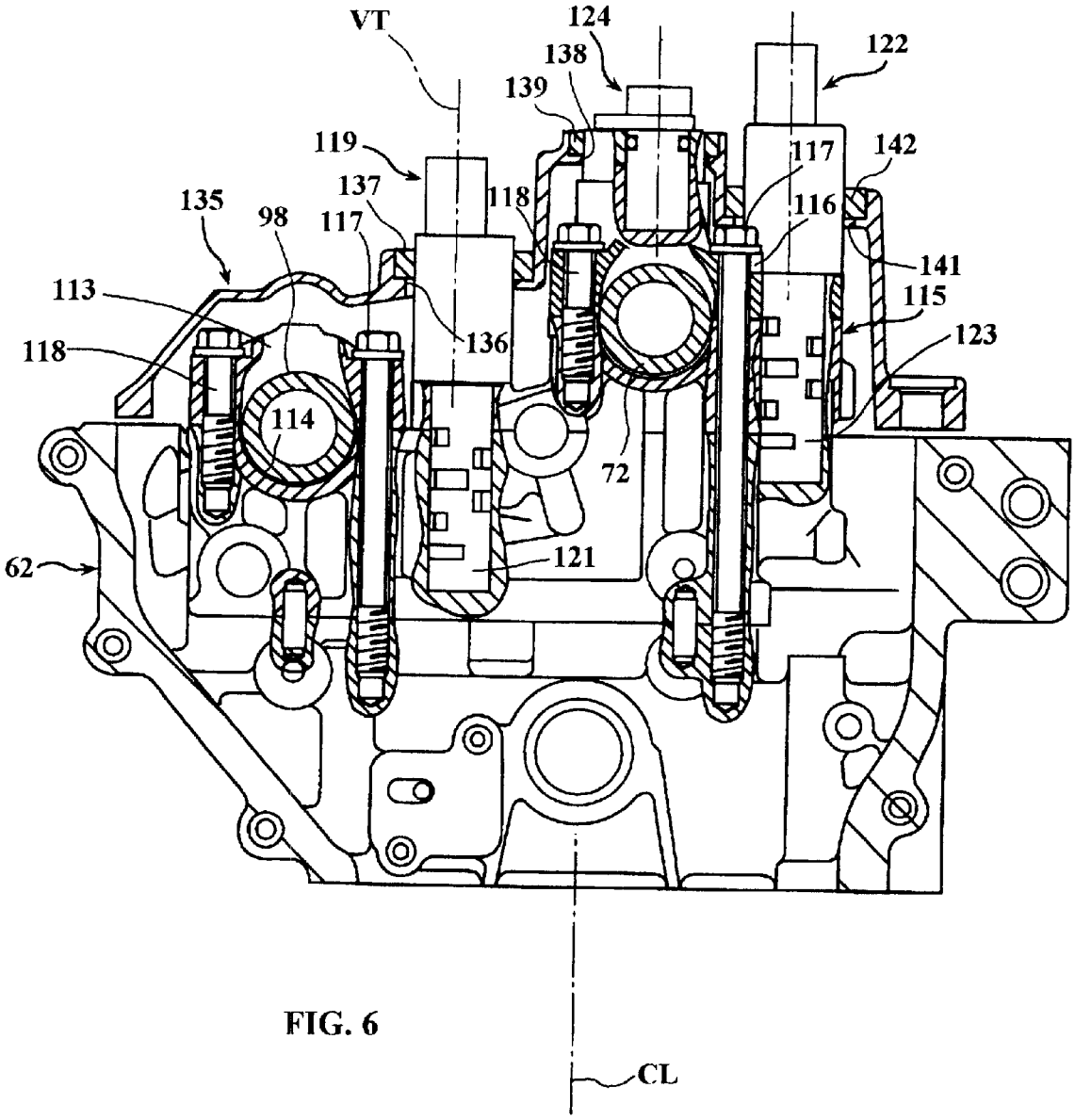
FIG. 6 is a cross sectional view in part similar to FIG. 4 but closer to the end of the engine where the cam shafts are driven.
Figure 7:
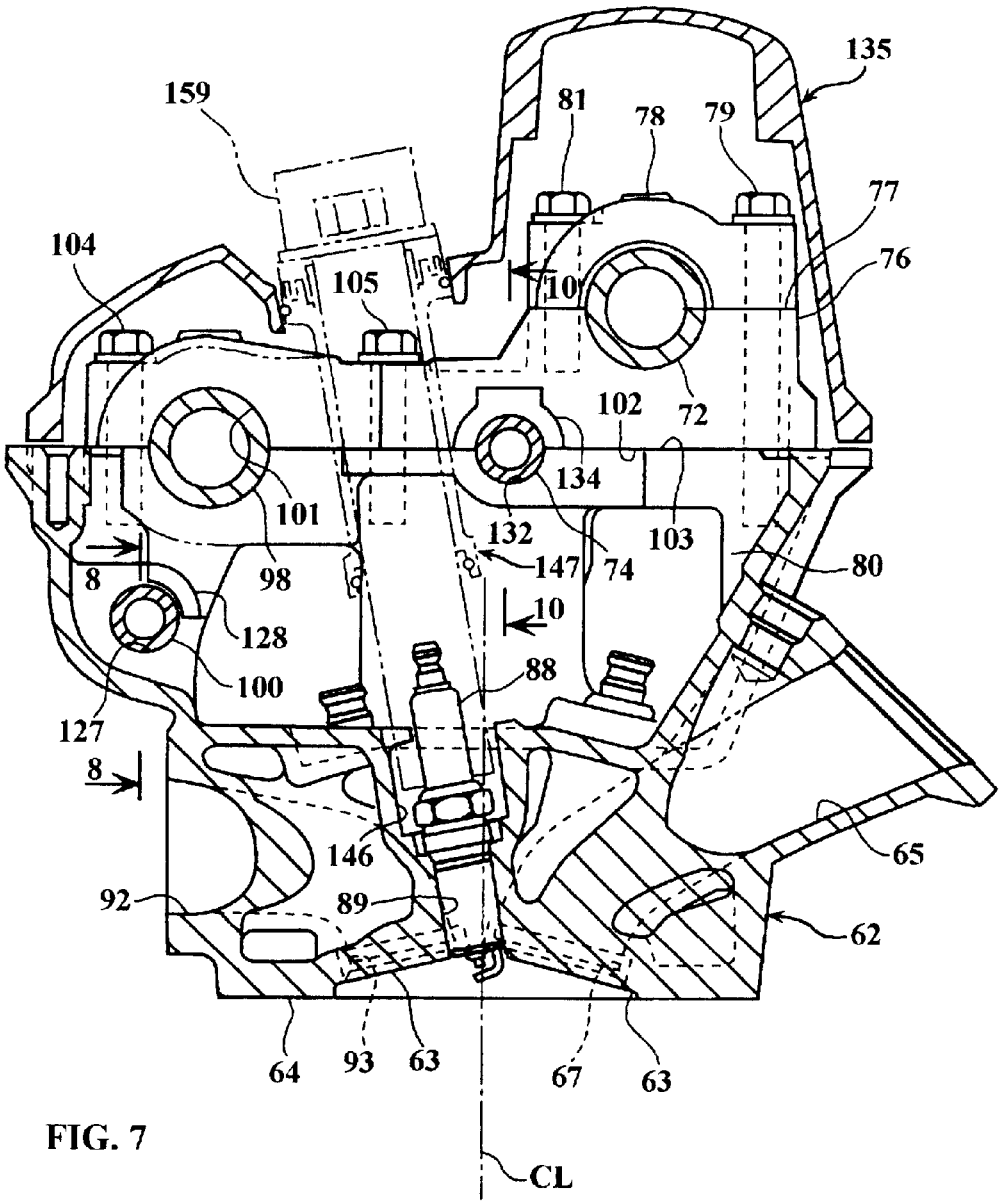
FIG. 7 is a cross sectional view in part similar to FIG. 4 and 6 but with the rocker arms removed.
Figure 8:
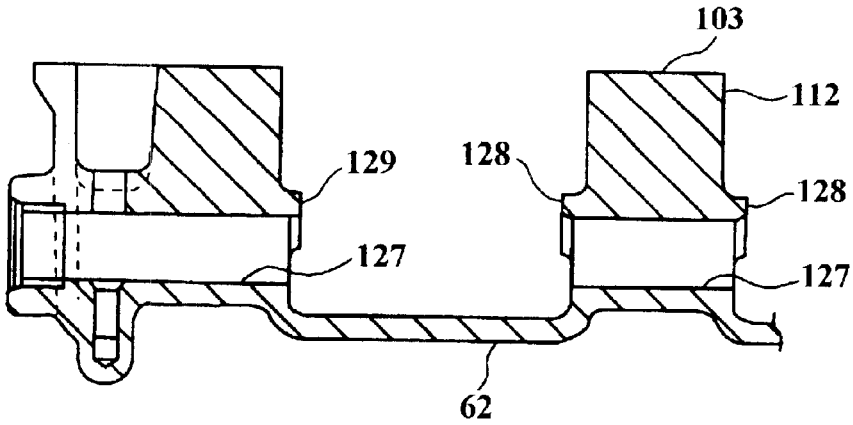
FIG. 8 is a cross sectional view taken along the line 8—8 of FIG. 7.

At the front of the engine 51 and adjacent the driving sprockets 107, 108, 109 and 111, a somewhat different bearing arrangement is employed. This bearing arrangement is shown in FIG. 6 and is comprised of a bearing cap 113 that cooperates with a bearing surface 114 formed in an intermediate bearing member 115 for journaling the front end of the exhaust camshaft 98. The intermediate bearing member 115 also journals the adjacent end of the intake camshaft 72 along with a bearing cap 116. Long fasteners 117 pass through the bearing caps 113 and 16 into the cylinder head 62 for securing these members together. Shorter fasteners 118 pass through only the bearing caps 113 and 116 and the intermediate bearing member 115 for completing the hold down of the bearing caps 113 and 116.

The timing drive for driving the intake and exhaust camshafts 72 and 98, respectively, including the sprockets 108, 109 and 111 can employ a variable valve timing mechanism. This variable valve timing mechanism is controlled by a solenoid operated pilot valve 119 that is mounted on an axis VT at the front of the engine and may be of any known type that varies the timing of one or both of the camshafts 72 and 98 relative to the crankshaft. This solenoid operated pilot valve 119 includes a valve spool 121 that cooperates with suitable passages formed in the intermediate bearing member 115 for varying the valve timing.

In addition, a variable valve lift mechanism is provided in either or both of the rocker arm assemblies 73 and 99 for varying the degree of lift of the valves operated by these rocker arm assemblies 73 and 99. This variable valve lift mechanism may comprise, for example, two different rocker arms operated by different cam lobes and which are selectively coupled by a suitable coupling mechanism of any known type for their operation. A solenoid operated valve assembly, indicated generally by the reference numeral 122 is associated with the intake camshaft mounting assembly for controlling this variable lift mechanism. The valve assembly 122 includes a valve spool 123 that cooperates with suitable passages formed in the intermediate bearing member 115 for varying the valve lift. Of course, the solenoid operated pilot valves 119 and 122 may have their functions reversed.

In addition, the bearing cap 116 for supporting the front end of the intake camshaft also carries a phase angle sensor 124 which may be of any known type and outputs a signal to an ECU indicating the camshaft phase. This can be used for both varying the valve timing and lift as well as fuel injection and spark timing.

The cylinder head 62 is affixed to the associated cylinder block 54 and specifically the banks thereof by threaded fasteners. These threaded fasteners pass through holes 125 formed in the cylinder head 62 in the area of the front camshaft bearings but slightly to the rear of them and additional holes 126 that are formed in the area between the camshaft bearing portions provided by the raised cylinder head areas 112 and 80 which are aligned with each other as shown in FIG. 3.

It has been previously noted that the variable valve lift rocker arm assemblies 73 and 99 are mounted on rocker arm shafts 74 and 100, respectively. The mounting arrangement for these rocker arms shafts will now be described by particular reference to FIGS. 7 through 10.

Referring first to the support for the exhaust valve rocker arm assembly 99, it will be seen that the cylinder head 62 is formed in the area of the raised area 112 with a shaft opening 127 through which the exhaust camshaft rocker arm shaft 100 passes. As may be seen in FIG. 8, the side surfaces of the intermediate raised area 112 are provided with outwardly facing shoulders 128 which form thrust surfaces for the rocker arm assembly 99 and the rocker arm shaft 100. The front most raised portion on which the bearing cap 113 is mounted, is formed with a thrust taking outwardly facing shoulders 129.

Figure 9:
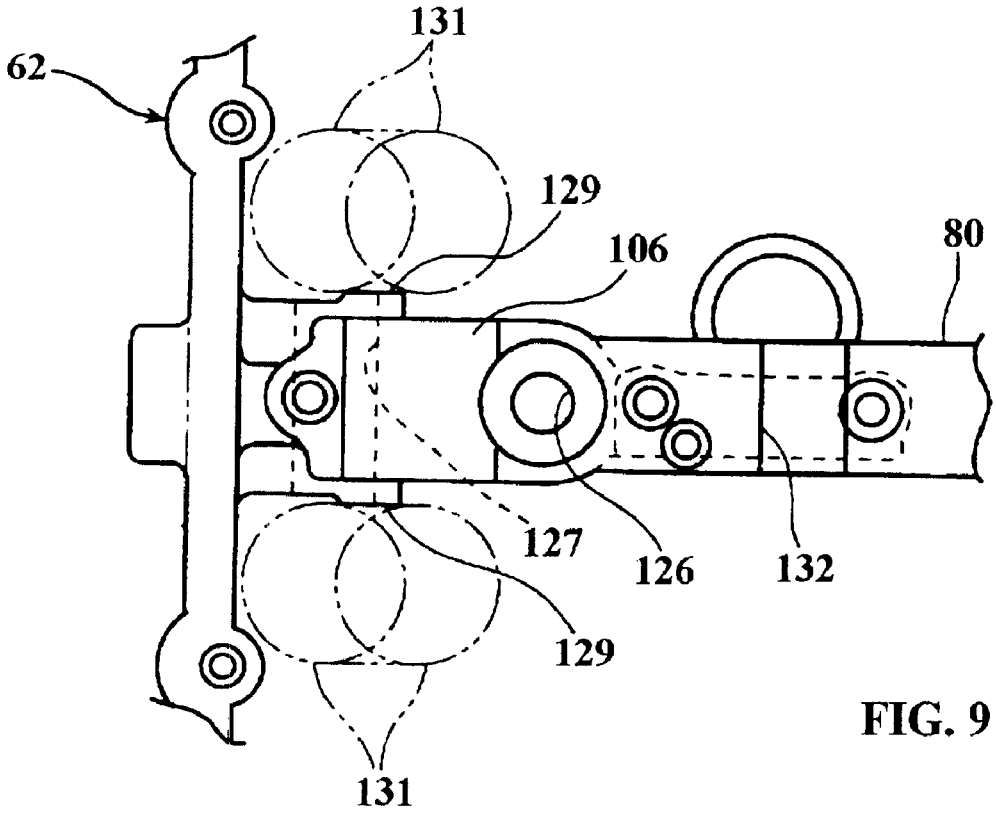
FIG. 9 is a top plane view of the portion of the cylinder head shown in cross section in FIG. 8.
Figure 10:
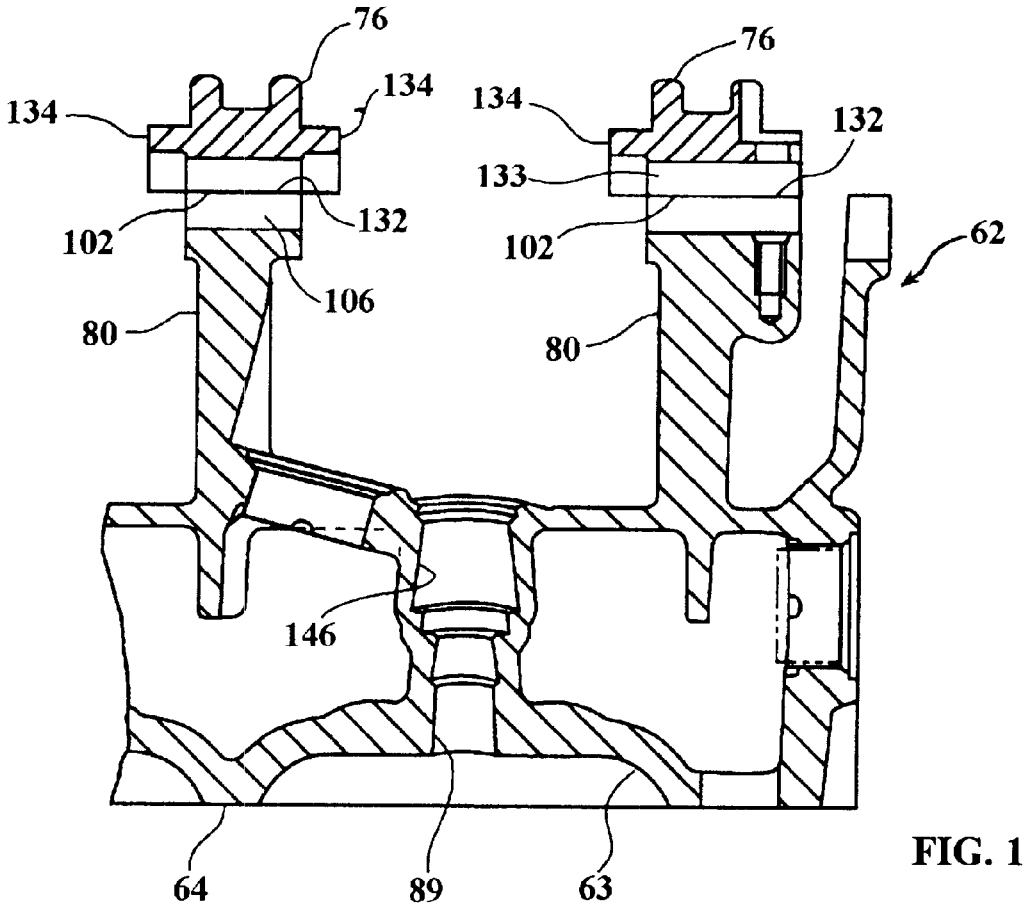
FIG. 10 is a cross sectional view taken along the line 10—10 of FIG. 7.

As may be seen in FIG. 9, these outwardly facing shoulders 128 and 129 may be machined by a cutting tool indicated in phantom line by the reference numeral 131 in FIG. 9 so as to machine the thrust surfaces for the appropriate type of rocker arm and shaft assembly utilized for providing the variable lift.

In connection with the intake rocker arm assembly 73 and specifically its rocker arm shaft 74, this is journalled by a first bearing surface 132 formed in the cylinder head elevated surface 103 with which the lower part 102 of the intermediate bearing portion 76 is engaged. The intermediate bearing portion 76 is formed with a complimentary bearing surface 133 and this surface is bounded on one or both sides by thrust taking projections 134 formed on the bearing caps 78. Again, by machining these surfaces it is possible to accommodate difference types of variable lift mechanisms and rocker arm assemblies.

The valve actuating mechanism which has been thus far described is mounted in part within the cylinder head 62 in a cam chamber formed at its upper portion. This cam chamber is closed by a cam cover, indicated generally by the reference numeral 135. The cam cover 135 is detachably affixed to the cylinder head 62 in any suitable manner.

The mounting arrangement for the camshafts also provides a more compact arrangement that facilitates mounting in compact engine compartments particularly those having transverse engine placement as seen in FIG. 2. If the camshafts 72 and 98 were positioned at the same level as shown by the phantom line view 98A in this figure, the cylinder head and cam cover 135 would have to be quite a bit larger and the engine moved forwardly. However, with the lower mounting of the exhaust or outside camshaft as seen in this figure, the length L can be substantially reduced and the engine can be easily serviced even without moving the crankshaft axis forwardly.

Figure 5:
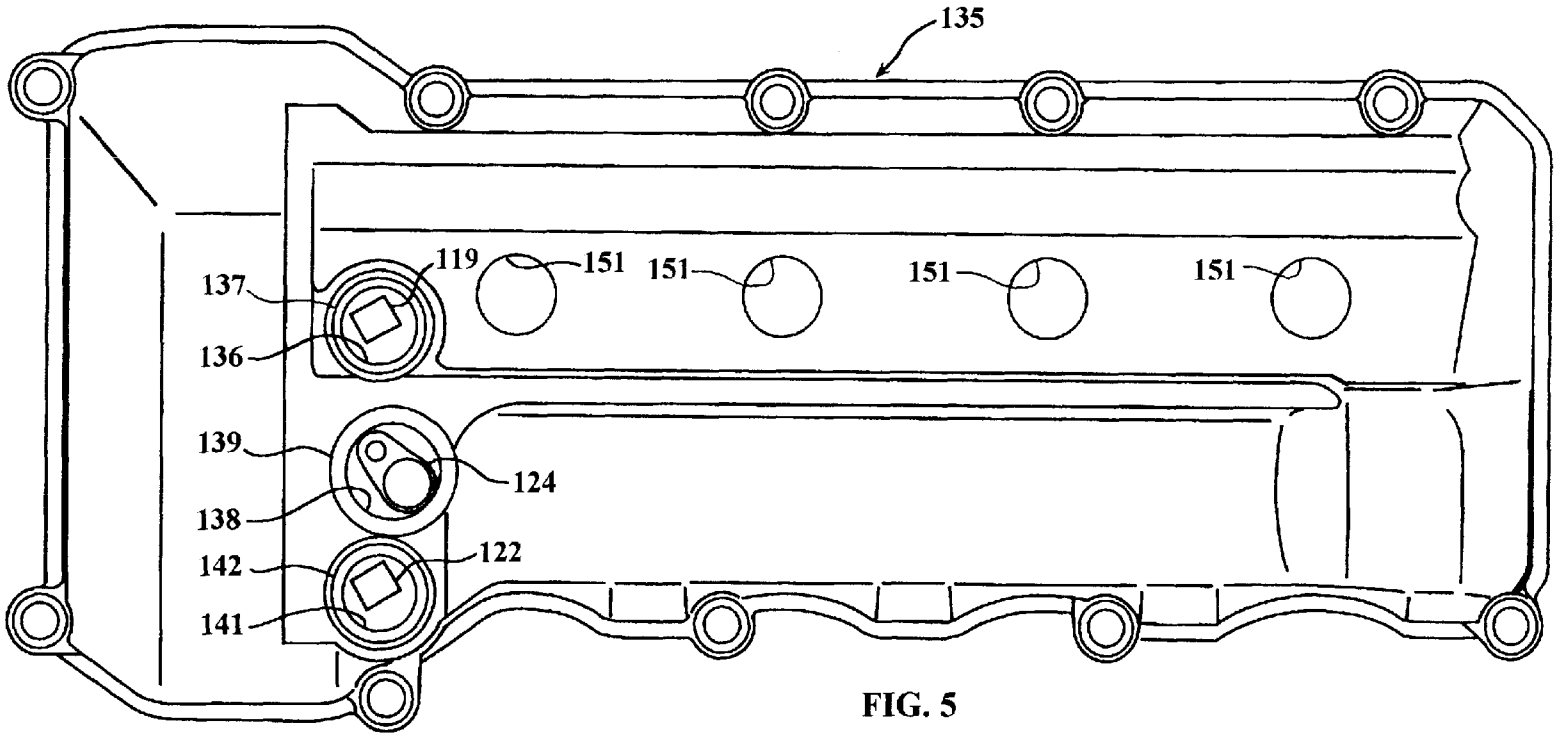
FIG. 5 is a top plane view of the cylinder head assembly.

It has been previously noted that the solenoid operated pilot valves 119 and 122 for controlling the valve timing and valve lift and the sensor 124 for controlling at least in part their operation extend upwardly from the respective supporting members i.e. the intermediate member 115, the bearing caps 116. These members also extend through openings in the cam cover 135 as best seen in FIGS. 5 and 6.

For example, the solenoid operated pilot valve 119 extends through an opening 136 formed in the cam cover 135 and is surrounded by a sealing elastic ring 137. In a like manner, the cam phase angle sensor 124 passes through an opening 138 formed in the cam cover 135 and is sealingly engaged by an annular elastic seal 139. Finally, the solenoid operated valve 122 extends through an opening 141 formed in the cam cover 135 and is sealed by an elastic seal 142. Thus, each of these members 119, 122 and 124 may be readily serviced without having to remove the cam cover 135.

The mounting and servicing for the spark plugs 88 will now be described by reference primarily to FIGS. 4, 5, 7, 10 and 11. It has been previously noted that the spark plugs 88 have their threaded portions received in threaded openings 89 formed in the cylinder head 62. A spark plug receiving tube assembly, indicated generally by the reference numeral 143, extends from the area adjacent this cylinder head threaded spark plug receiving openings 89 through the cam cover 135.

This spark plug receiving tube assembly 143 includes a lower tube 144 and an upper tube 145. A two-part tube structure is employed for the reasons which will be apparent very shortly and which overcome the servicing problems attended with the prior art type of constructions as mentioned in conjunction with the description of FIG. 1.

The cylinder head 62 is formed with a bored, plug tube receiving opening 146 in which the lower end of the lower spark plug tube 144 is fitted with a press type fit. This opening 146 is concentric to the axis of the spark plug 88 indicated at PA in FIG. 4.

The upper spark plug receiving tube 145 is formed with a flanged lower part 147 that is sized so as to snugly engage the outer periphery 148 of the lower spark plug tube 144. If desired, an O-ring seal may be provided in this area.

The upper end of the upper spark plug receiving tube portion 145 has an enlarged flange 149 which is complimentary to and received in an enlarged opening 151 formed in the cam cover 135. Again, an O-ring seal, indicated at 152 may be provided in this area.

A combined coil mounting and spark plug terminal assembly, indicated generally by the reference numeral 153 is mounted on the tube assembly 143 and includes a terminal portion that is complimentary to and received on the terminal 154 of the spark plug 88. This terminal portion, indicated by the reference numeral 155, is mounted at the upper end of the coil and terminal assembly 153 on a plastic sealing plug 156. A mounting flange portion 157 is formed at the upper end thereof and it has a projection 158 which sealingly engages a recess formed in the upper plug tube end flange 149.

A coil assembly 159 is mounted on this flange 157 and receives input from a terminal 161 which communicates with the ECU for engine control.

Because of the two-piece spark plug tube arrangement 145, the engine embodying the invention is much easier to build and assemble and hence, can have a reduced cost. Unlike the prior art construction, the cylinder head assembly can be completed with the lower plug tube 144 in position and then the cam cover 135 installed. After the cam cover 135 is installed, then the upper plug tube 145 can be installed one cylinder at a time, rather than having to line up with all of the cylinders simultaneously. This greatly facilitates assembly. Subsequently, the coil carrier and terminals 153 may be installed and the electrical connections made to the connectors 161.

Figure 1:
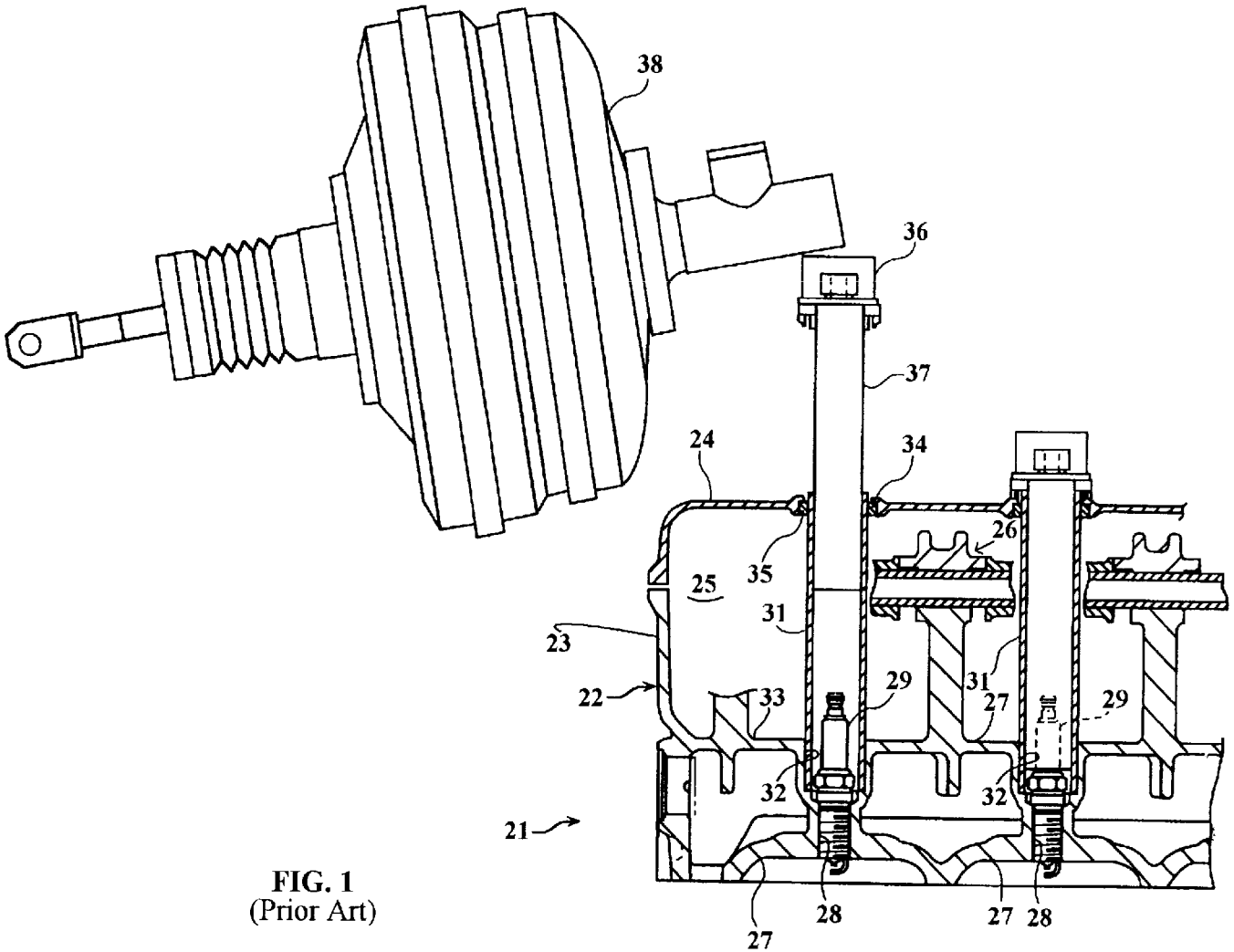
FIG. 1 (Prior Art)
FIG. 1 is a cross sectional view showing a portion of a prior art internal combustion engine and an associated component of a vehicle powered by the engine.
Figure 11:
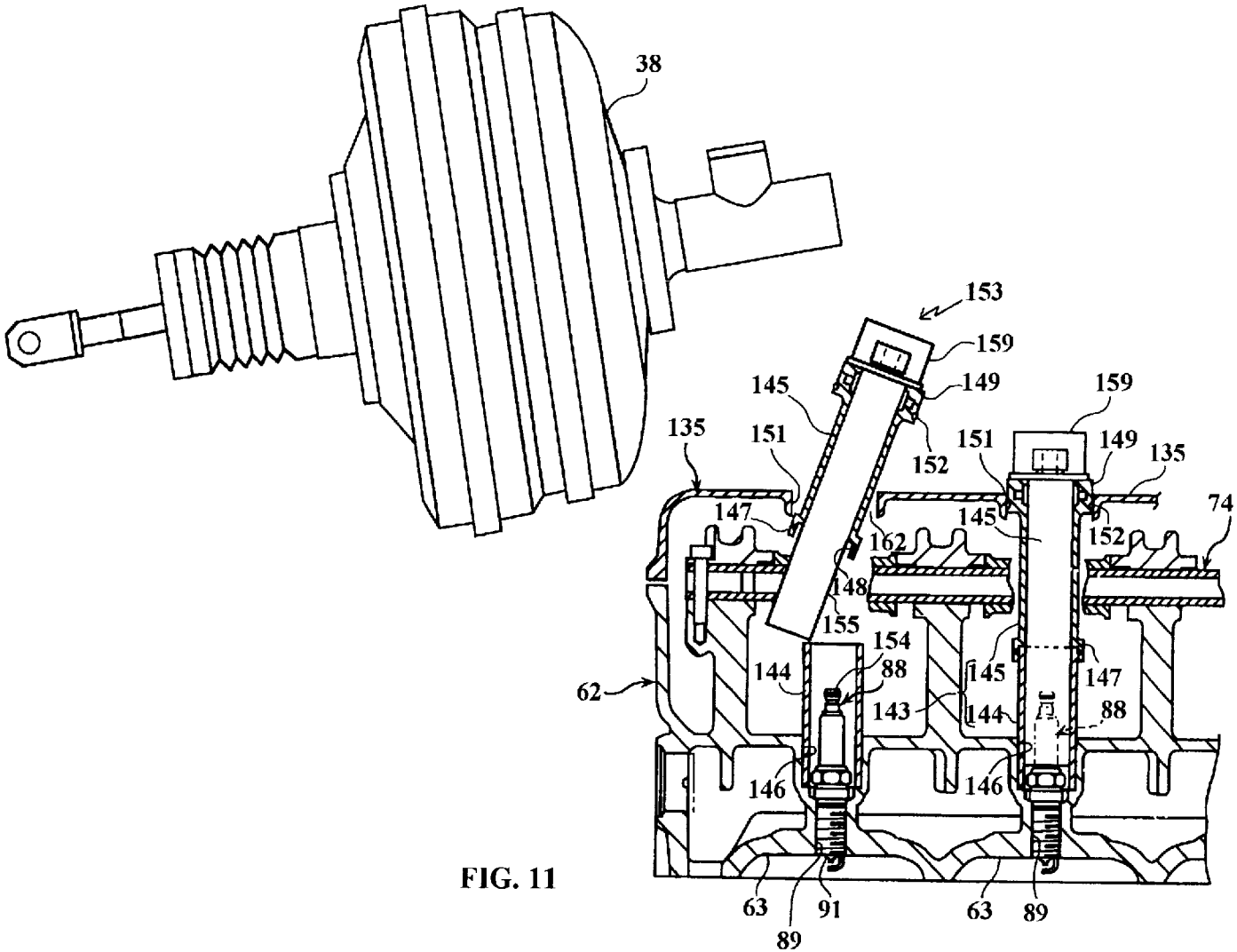
FIG. 11 is a view, in part similar to FIG. 1, and shows how the removal of the coil and spark plug attaching terminal is facilitated with this invention.

The servicing arrangement is also made much easier as may be seen in FIG. 11, particularly when comparing this with FIG. 1. In this case, when there is an obstruction such as the break booster 38 above the spark plug opening 151 in the cam cover 135, there is no problem for servicing. First, the coil and terminal assembly 153 can be removed in a unit along with the upper plug tube 145 by canting the structure. This is possible because the opening 151 in the cam cover 135 can be made large enough to clear the flanged lower part 147 as well as to provide additional clearance as seen by the gap 162 in this figure. Once this assembly is removed, there will considerable room for accessing the spark plug 88 for its removal and replacement. Obviously, reinstallation of the upper plug tube 145 is possible in the reverse mode.

Thus, from the foregoing description, it should be readily apparent from the described construction that is permits a very compact engine and one which is easy to assemble and service and which leads itself to confined engine compartments without significant problems in the servicing. Of course, the foregoing description is that of a preferred embodiment of the invention and various changes and modification may be made without departing from the spirit and scope of the invention, as defined by the appended claims.

What is claimed is:

1. A cylinder head assembly for an internal combustion engine comprising a cylinder head, a cam cover affixed to said cylinder head and defining a cam chamber between an upper surface of said cylinder head and the interior of said cam cover, said cylinder head being formed with at least one spark plug thread hole leading into a combustion chamber of said cylinder head, said cylinder head forming a spark plug tube attaching hole greater in diameter and surrounding said at least one spark plug thread hole, a spark plug tube inserting hole formed in said cam cover aligned with said cylinder head plug tube attaching hole, a lower spark plug tube sealingly affixed at one end thereof to said cylinder head spark plug tube attaching hole, and an upper spark plug tube sealingly affixed at one end thereof to said cam cover spark plug tube attaching hole and sealingly engaged at the other end thereof to the other end of said lower spark plug tube.

2. A cylinder head assembly for an internal combustion engine as set forth in claim 1, wherein the upper and lower spark plugs tubes are adapted to receive a coil member and terminal for attachment to a spark plug mounted in the spark plug thread hole of the cylinder head.

3. A cylinder head assembly for an internal combustion engine as set forth in claim 2, wherein the upper spark plug tube sealing affixation to the cam cover is readily detachable.

4. A cylinder head assembly for an internal combustion engine as set forth in claim 2, wherein the upper end of the lower spark plug tube and the lower end of the upper spark plug tube have a flanged connection.

5. A cylinder head assembly for an internal combustion engine as set forth in claim 4, wherein the lower end of the upper spark plug tube forms the female portion of the flanged connection.

6. A cylinder head assembly for an internal combustion engine as set forth in claim 5, wherein the upper spark plug tube sealing affixation to the cam cover is readily detachable and the opening in the cam cover has a diameter considerably larger than the female portion of the upper spark plug tube.

* * * * *